US007310955B2

(12) United States Patent
Hume et al.

(10) Patent No.: US 7,310,955 B2
(45) Date of Patent: Dec. 25, 2007

(54) SYSTEM AND METHOD FOR DELIVERING CRYOGENIC FLUID

(75) Inventors: Howard R. Hume, Littleton, CO (US); Ronald R. Warnecke, Idaho Falls, ID (US); Gary L. Palmer, Shelley, ID (US); Leslie J. Fekete, Littleton, CO (US)

(73) Assignee: NitroCision LLC, Idaho Falls, ID (US)

( * ) Notice: Subject to any disclaimer, the term of this patent is extended or adjusted under 35 U.S.C. 154(b) by 560 days.

(21) Appl. No.: 10/934,901

(22) Filed: Sep. 3, 2004

(65) Prior Publication Data

US 2006/0053165 A1 Mar. 9, 2006

(51) Int. Cl.

| | |
|---|---|
| ***F17C 7/02*** | (2006.01) |
| ***F17C 13/00*** | (2006.01) |
| ***B24B 1/00*** | (2006.01) |
| ***B24C 1/00*** | (2006.01) |

(52) U.S. Cl. ..... 62/52.1; 62/50.7; 451/39

(58) Field of Classification Search ..... 62/52.1, 62/50.7; 451/39

See application file for complete search history.

(56) References Cited

U.S. PATENT DOCUMENTS

| | | | | |
|---|---|---|---|---|
| 3,730,201 | A * | 5/1973 | Lefever | 406/197 |
| 4,178,761 | A * | 12/1979 | Schwartzman | 60/648 |
| 4,396,354 | A | 8/1983 | Thompson et al. | 417/53 |
| 4,838,912 | A * | 6/1989 | Amlinger | 62/616 |
| 5,341,608 | A * | 8/1994 | Mains, Jr. | 451/39 |
| 5,733,174 | A * | 3/1998 | Bingham et al. | 451/39 |
| 5,787,940 | A | 8/1998 | Bonn et al. | 141/18 |
| 5,795,626 | A | 8/1998 | Gabel et al. | |
| 5,823,669 | A * | 10/1998 | Jones | 366/132 |
| 6,074,135 | A | 6/2000 | Tapphorn et al. | |
| 6,244,053 | B1 * | 6/2001 | Gulati et al. | 62/50.1 |
| 6,581,390 | B2 * | 6/2003 | Emmer et al. | 62/50.6 |
| 6,640,556 | B2 | 11/2003 | Ursan et al. | 62/50.6 |
| 6,715,640 | B2 | 4/2004 | Tapphorn et al. | |
| 2003/0215341 | A1 * | 11/2003 | Maiefski et al. | 417/313 |
| 2005/0274139 | A1 * | 12/2005 | Wyatt | 62/498 |

OTHER PUBLICATIONS

"Cold spray technology—prospects and applications", Surface Engineering, vol. 18, No. 5, pp. 321-323, 2002.

Brochure entitled "Solid Particle Spray Process", Ktech Corporation, Albuquerque, NM 87106 (6 pages).

Notification of Transmittal of the International Search Report and the Written Opinion of the International Searching Authority or the Declaration with attached PCT International Search Report and Written Opinion, dated Jan. 23, 2006, 8 pages.

* cited by examiner

*Primary Examiner*—William C Doerrler
(74) *Attorney, Agent, or Firm*—Baker Botts L.L.P.

(57) ABSTRACT

According to an embodiment of the present invention, a cryogenic fluid delivery system includes a vessel containing a cryogenic fluid at a first pressure and a first temperature, a first heat exchanger coupled to the vessel for receiving the cryogenic fluid and cooling the cryogenic fluid to a second temperature, a first pump coupled to the first heat exchanger for pressurizing the cryogenic fluid to a second pressure, a second pump for pressurizing the cryogenic fluid to a third pressure, a second heat exchanger coupled to the second pump for cooling the cryogenic fluid to a third temperature, and a nozzle coupled to the second heat exchanger for delivering a jet of the cryogenic fluid toward a target.

24 Claims, 6 Drawing Sheets

SYSTEM AND METHOD FOR DELIVERING CRYOGENIC FLUID

TECHNICAL FIELD OF THE INVENTION

This invention relates in general to fluid dynamic machining and, more particularly, to a system and method for delivering a cryogenic fluid.

BACKGROUND OF THE INVENTION

In fluid dynamic machining the force resulting from the momentum change of the fluid stream is utilized to cut, abrade, or otherwise machine materials. For example, water is often used as a fluid to cut or abrade certain materials and various abrasive materials may be used to enhance material removal. However, water jet machining may suffer from problems relating to the collection of the water during the machining operation or problems relating to the potential contamination of the water or surrounding environment from the material removed from the workpiece.

To address the foregoing problems, sublimable particles, such as dry ice, may be used as the cutting material. The primary advantage of using sublimable particles is that there is no secondary waste material to be collected: the dry ice particles change to gaseous carbon dioxide ($CO_2$) shortly after striking the workpiece. The gaseous carbon dioxide may then be discharged into the atmosphere. Liquid nitrogen may also be utilized as the fluid medium. Since both carbon dioxide and nitrogen are present in the atmosphere in substantial quantities, venting them into the atmosphere should not pose any problems.

SUMMARY OF THE INVENTION

According to an embodiment of the present invention, a cryogenic fluid delivery system includes a vessel containing a cryogenic fluid at a first pressure and a first temperature, a first heat exchanger coupled to the vessel for receiving the cryogenic fluid and cooling the cryogenic fluid to a second temperature, a first pump coupled to the first heat exchanger for pressurizing the cryogenic fluid to a second pressure, a second pump for pressurizing the cryogenic fluid to a third pressure, a second heat exchanger coupled to the second pump for cooling the cryogenic fluid to a third temperature, and a nozzle coupled to the second heat exchanger for delivering a jet of the cryogenic fluid toward a target.

Embodiments of the invention provide a number of technical advantages. Embodiments of the invention may include all, some, or none of these advantages. For example, in one embodiment, a cryogenic fluid delivery system provides a fluid stream capable of a high pressure and high velocity in order to cut or otherwise machine a wide variety of materials. Such a system may be used in medical applications, such as liver or other types of surgery. By utilizing a cryogenic fluid, such as nitrogen, no secondary waste material needs to be collected; the supercritical nitrogen evaporates shortly after cutting or striking a workpiece. Since nitrogen is present in the atmosphere in substantial quantities, venting into the atmosphere should not pose any problems.

In another embodiment, a cryogenic fluid delivery system is utilized in cold spraying. Small metal particles or carbon dioxide may be entrained within the fluid stream before exiting a nozzle. Such a system may be used to perform functions such as sandblasting or to replace electroplating.

Other technical advantages are readily apparent to one skilled in the art from the following figures, descriptions, and claims.

DETAILED DESCRIPTION OF THE INVENTION

Embodiments of the present invention and some of their advantages are best understood by referring to FIGS. 1 through 9B of the drawings, like numerals being used for like and corresponding parts of the various drawings.

Figure 1:
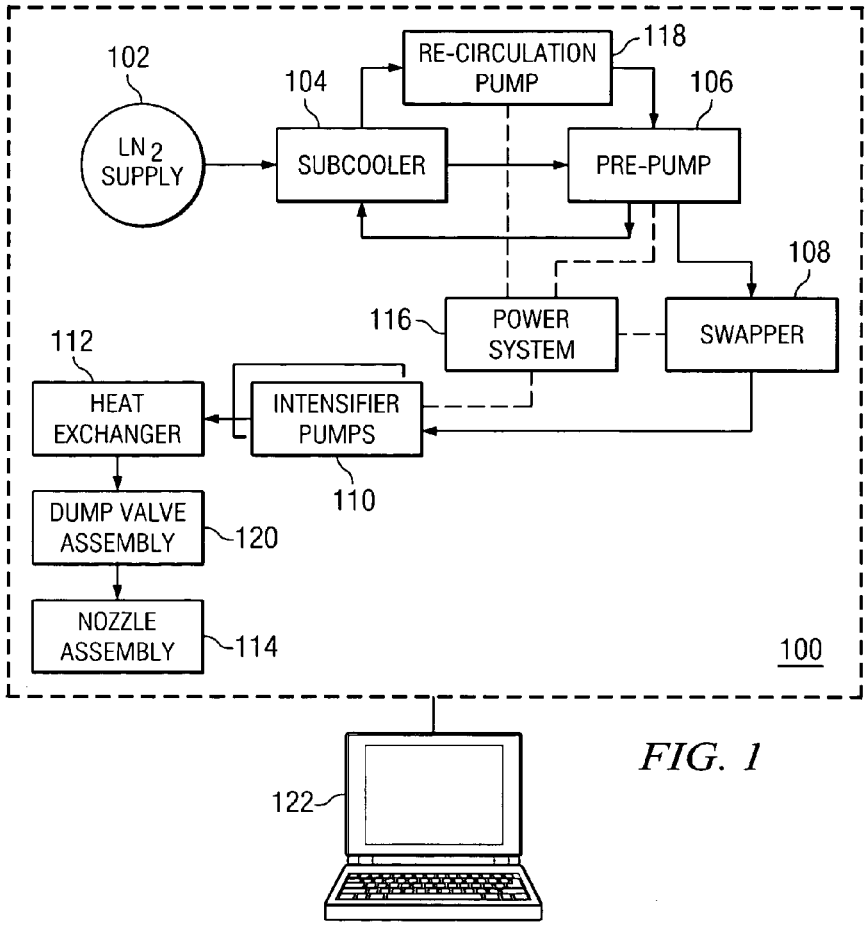
FIG. 1 is a functional block diagram of a cryogenic fluid delivery system according to one embodiment of the present invention.

FIG. 1 is a functional block diagram of a cryogenic fluid delivery system 100 according to one embodiment of the present invention. In the illustrated embodiment, delivery system 100 includes a liquid nitrogen supply 102, a subcooler 104, a pre-pump 106, a swapper 108, a pair of intensifier pumps 110, a heat exchanger 112, a nozzle assembly 114, a power system 116, a recirculation pump 118, a dump valve assembly 120, and a controller 122. The present invention, however, contemplates delivery system 100 having more, less, or different components than those illustrated in FIG. 1. Generally, cryogenic fluid delivery system 100 provides a cryogenic fluid stream capable of high pressure and high velocity in order to cut, abrade, or otherwise suitably machine a wide variety of materials. The components of delivery system 100 may be incorporated into a single structure, such as a skid, or may be separate components arranged in any suitable manner. Details of the components of delivery system 100 are described below in conjunction with FIGS. 2 through 9B.

Although not described in detail, each of the components may be coupled to one another via any suitable piping adapted to transport a suitable cryogen at various temperatures and pressures. This piping may include other suitable components, such as valves, pumps, and reducers, and may be any suitable size depending on the process criteria. As an example, piping from liquid nitrogen supply 102 to subcooler 104 may be a ¾ inch diameter pipe. Temperatures and pressures associated with system 100 may vary depending on the particular implementation of system 100.

Liquid nitrogen supply 102 functions to store nitrogen, typically in liquid form, although some gas nitrogen may be present. Although nitrogen is used throughout this detailed description as the cryogenic fluid, the present invention contemplates other suitable cryogens for use in delivery system 100. In addition, the term "fluid" may mean liquid, gas, vapor, supercritical or any combination thereof. In one embodiment, liquid nitrogen supply 102 is a double wall tank storing liquid nitrogen at less than or equal to −270° F. and a pressure less than or equal to 80 psi. However, supply 102 may supply any suitable cryogen at any suitable temperature and any suitable pressure. In addition, supply 102 may function to provide system 100 with liquid nitrogen or other suitable cryogen at any suitable velocity, such as approximately three gallons per minute.

Sub-cooler 104 functions to sub-cool the liquid nitrogen received from liquid nitrogen supply 102 before it enters pre-pump 106. In one embodiment, sub-cooler 104 sub-cools the liquid nitrogen to approximately −310° F. In one embodiment, sub-cooler 104 is a shell-and-tube type heat exchanger; however, sub-cooler 104 may take the form of other suitable heat exchangers. In addition to receiving liquid nitrogen from liquid nitrogen supply 102, sub-cooler 104 may also receive recycled nitrogen from pre-pump 106, as described in greater detail below in conjunction with FIG. 2. This recycling of the nitrogen from pre-pump 106 to sub-cooler 104 may be accomplished by recirculation pump 118.

Pre-pump 106 boosts the pressure of the liquid nitrogen received from sub-cooler 104 to a higher pressure. In one embodiment, pre-pump 106 boosts the pressure of nitrogen to between approximately 15,000 and 20,000 psi for use by intensifier pumps 110. Because of the boosting of the pressure of the nitrogen by pre-pump 106, the temperature of the nitrogen drops from −310° F. to somewhere between approximately −170° F. and −190° F. Further details of pre-pump 106 are described below in conjunction with FIG. 3.

Swapper 108 is a heat exchanger that receives the colder incoming supercritical nitrogen from pre-pump 106 and warmer supercritical nitrogen from intensifier pumps 110 in countercurrent flow directions. Heat is then swapped or exchanged between the two streams resulting in the heating of the incoming nitrogen prior to delivering it to intensifier pumps 110 and pre-cooling the discharge from the intensifier pumps 110 prior to feeding it to heat exchanger 112. Details of swapper 108 are described in greater detail below in conjunction with FIG. 4.

Intensifier pumps 110 raise the pressure of supercritical nitrogen, for example, from approximately 15,000 psi to 55,000 psi via compression. Details of intensifier pumps 110 are described below in conjunction with FIG. 5. Intensifier pumps 110 work in conjunction with swapper 108, as described in greater detail below.

Heat exchanger 112 cools the high pressure supercritical nitrogen from intensifier pumps 110 to approximately −235° F. In one embodiment, heat exchanger 112 is a suitable shell-and-tube type heat exchanger; however, heat exchanger 112 may be other suitable types of heat exchangers. Details of heat exchanger 112 are described below in conjunction with FIG. 6.

Nozzle assembly 114 receives the cooled cryogenic fluid from heat exchanger 112 and produces a high velocity jet stream to be used for cutting, abrading, coating, or other suitable machining operations. Details of some embodiments of nozzle assembly 114 are described below in conjunction with FIGS. 8 and 9. In one embodiment, the velocity of the jet stream delivered by nozzle 114 may be approximately Mach 3; however, other suitable velocities are contemplated by the present invention. Dump valve assembly 120 functions to release supercritical nitrogen to the atmosphere in order to keep a smooth, responsive flow of nitrogen delivered to nozzle 114 if the stream to the nozzle should need to be interrupted for any reason (e.g., to reposition an item being cut or abraded). In one embodiment, dump valve assembly 120 comprises suitable three-way valves that are air operated; however, other suitable valves may be contemplated by the present invention for dump valve assembly 120.

Power system 116 provides power to both pre-pump 106 and intensifier pumps 110. Power system 116 enables a smooth flow of supercritical nitrogen through delivery system 100 and may be any suitable power system, such as a hydraulic system, a pneumatic system, or an electrical system. Details of one embodiment of power system 116 are described below in conjunction with FIG. 7. Power system 116 may also provide power for re-circulation pump 118 and swapper 108 in some embodiments. In the case of a hydraulic system, power system 116 may include suitable reservoirs, piping, pumps, valves, and other components to operate pumps 106, 110, and/or 118.

Controller 122 may be any suitable computing device having any suitable hardware, firmware, and/or software that controls cryogenic fluid delivery system 100. For example, controller 122 controls the valves and valve sequencing of power system 116, as described below in conjunction with FIG. 7, and generally monitors and controls temperatures and pressures throughout system 100 as well as other components, such as pressure relief valves to provide safe operation of system 100. An embodiment where the components of delivery system 100 are all contained on one skid, controller 122 may or may not be separate from the skid. Controller 122 may also have the option of providing an operator of delivery system 100 with critical operating parameters. For example, via a touch-screen control panel, an operator may control the more relevant operating parameters, such as output temperature and output pressure. Both cool-down and ramp-up processes may also be controlled by controller 122.

Figure 2:
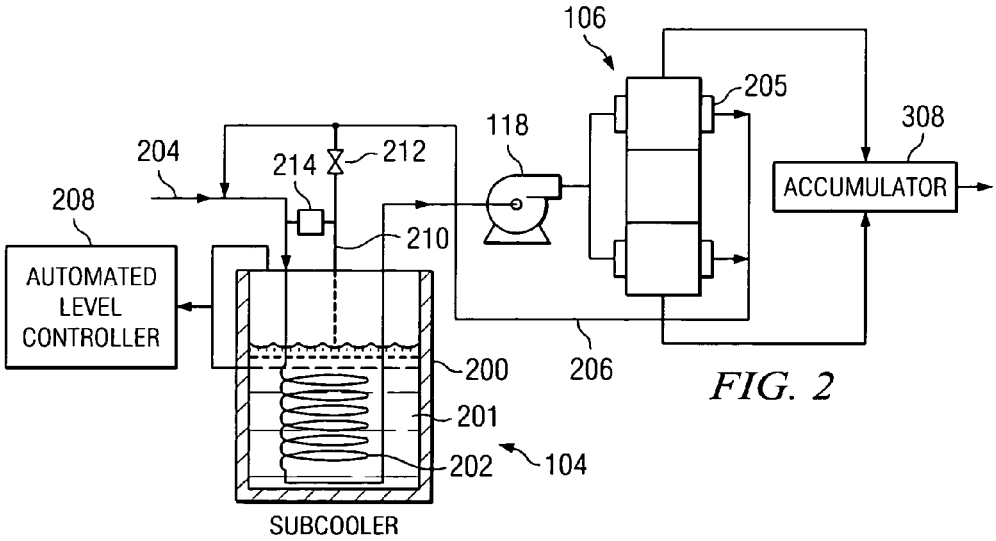
FIG. 2 is a schematic of a subcooler and a pre-pump according to one embodiment of the present invention.

FIG. 2 is a schematic of sub-cooler 104 and pre-pump 106 according to one embodiment of the present invention. In the illustrated embodiment, sub-cooler 104 includes a vessel 200 storing a coolant 201, such as liquid nitrogen, and piping 202 disposed within vessel 200. Piping 202 receives liquid nitrogen from liquid nitrogen supply 102 via a feedline 204. Recirculation pump 118 is also coupled to piping 202 and is operable to deliver the cryogenic fluid running through piping 202 to pre-pump 106.

Recirculation pump 118 functions to raise the pressure of the liquid nitrogen from approximately 80 psi to approximately 130 psi in order to "prime" pre-pump 106, which results in a good net positive suction head to prevent cavitation. Recirculation pump 118 also functions to recirculate liquid nitrogen running through a pair of jackets 205 associated with pre-pump 106 back to sub-cooler 104 via a feedback line 206. In an embodiment where power system 116 (FIG. 1) is pneumatic, recirculation pump 118 may not be needed.

Feedback line 206 delivers the recirculated nitrogen back to feedline 204. In addition, coupled to feedback line 206 is a line 210 having an associated valve 212. Valve 212 works in conjunction with a automated level controller 208 associated with sub-cooler 104 in order to control the level of coolant 201 within vessel 200. For example, if the level starts to drop, automated level controller 208 actuates valve 212 open so that nitrogen running through feedback line 206 may enter vessel 200 via line 210.

Automated level controller 208 may be any suitable differential pressure transducer, such as a bubbler, a float, a laser sensor, or other suitable level controller. Automated level controller 208 may couple to vessel 200 in any suitable manner and in any suitable location. Reasons for controlling the level of coolant 201 within vessel 200 are to maintain proper subcooling of the incoming process liquid nitrogen and to prevent coolant 201 overflowing from vessel 200.

Also illustrated in FIG. 2, is a gas phase separator 214 coupled between feedline 204 and line 210. Gas phase separator 214 functions to direct any nitrogen gas within the nitrogen to line 210. In one embodiment, gas phase separator 214 includes a hand valve and a solenoid valve in series; however, other suitable valve arrangements are contemplated for gas phase separator 214.

Figure 3:
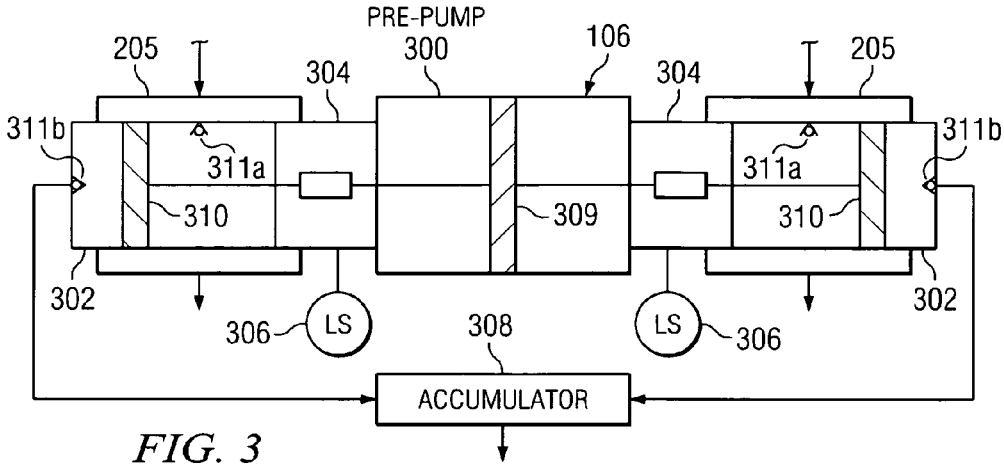
FIG. 3 is a more detailed schematic of a pre-pump according to one embodiment of the present invention.

FIG. 3 is a schematic of pre-pump 106 according to one embodiment of the present invention. In the illustrated embodiment, pre-pump 106 is a double-acting linear intensifier driven in both directions by a double-ended linear hydraulic piston 309 located in double-acting hydraulic cylinder 300. Power system 116 provides the power at a suitable pressure and flow rate to operate piston 309 in a linear reciprocating fashion. A pair of limit switches 306, which may be incorporated into spacers 304, signal the electronic controls to shift the directional control valve to reverse the direction of travel of piston 309. Pre-pump 106 also includes a pair of cold ends 302 separated from hydraulic cylinder 300 with a pair of intermediate spacers 304. Surrounding each cold end 302 is jacket 205 for accepting liquid nitrogen from sub-cooler 104 via recirculation pump 118 (FIG. 2).

As described above, pre-pump 106 functions as an amplifier that converts a low pressure liquid nitrogen to intermediate-pressure supercritical nitrogen. To accomplish this, pre-pump 106 is provided with a plunger 310 on each side of piston 309 to generate force in both directions of piston travel in such a way that while one side of pre-pump 106 is in the inlet stroke, the opposite side is generating intermediate-pressure discharge. Therefore, during the inlet stroke of plunger 310, liquid nitrogen enters cold end 302 under suction through a suitable check valve assembly 311*a*. After plunger 310 reverses motion of travel, nitrogen is compressed and exits at a predetermined elevated pressure through a suitable discharge check valve assembly 311*b*. This intermediate-pressure supercritical nitrogen, which is between approximately 15,000 to 20,000 psi, is then delivered to swapper 108.

Intermediate spacers 304 may have any suitable length and function to provide heat isolation and facilitate proper mechanical coupling between hydraulic cylinder 300 and cold ends 302. Intermediate spacers 304 may couple to hydraulic cylinder 300 in any suitable manner and cold ends 302 may couple to respective intermediate spacers 304 in any suitable manner, such as by a screwed connection. Also illustrated in FIG. 3 is an accumulator 308 (also known as a surge chamber) to smooth out the flow of nitrogen by taking out any pressure ripple therein.

Figure 4:
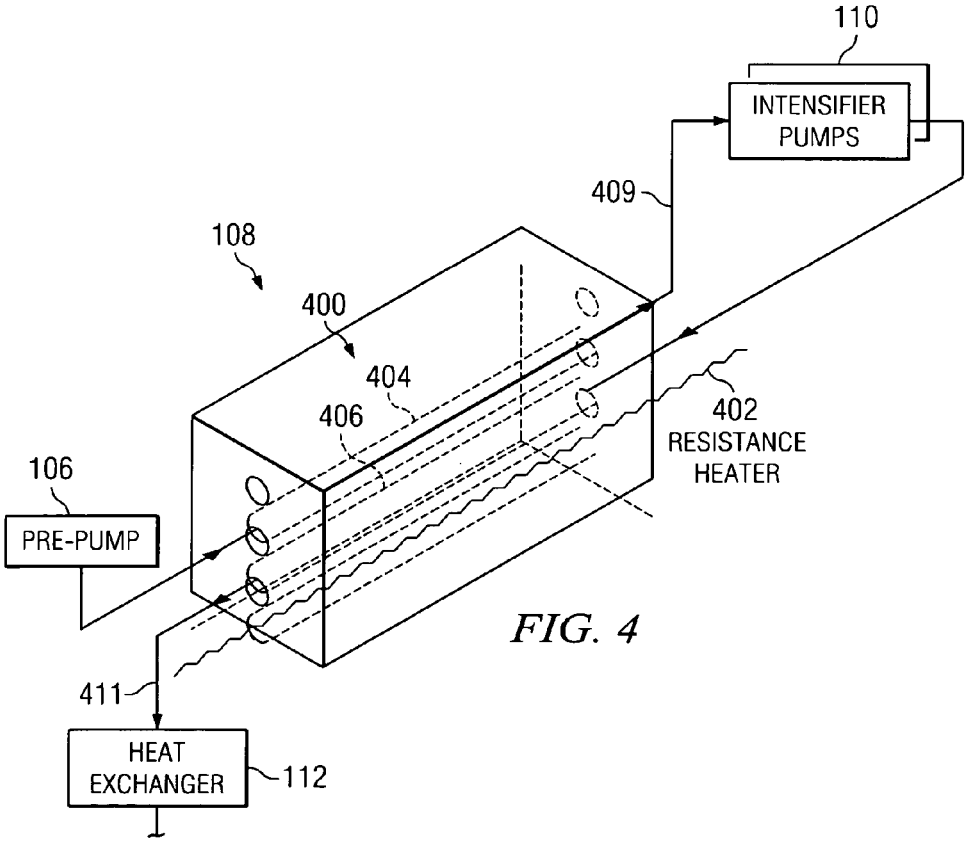
FIG. 4 is a schematic of a swapper according to one embodiment of the present invention.

FIG. 4 is a schematic of swapper 108 according to one embodiment of the present invention. In the illustrated embodiment, swapper 108 includes a solid body 400, a resistance heater 402 running through body 400, and a pair of conduits 404, 406 extending through body 400. In one embodiment, body 400 is formed from solid aluminum; however, other suitable materials are contemplated by the present invention. Resistance heater 402 may be any suitable heating unit that provides heat to body 400. Conduits 404, 406 may be any suitable size and shape and both function to transport nitrogen or other suitable cryogen therethrough.

As described above, swapper 108 is a heat exchanger that functions to receive incoming supercritical intermediate-pressure nitrogen from pre-pump 106 and supercritical nitrogen high-pressure discharge from intensifier pumps 110 in countercurrent flow directions. Both liquid streams are passed through body 400, in which heat is exchanged between the two streams resulting in the heating of incoming supercritical nitrogen prior to feeding to intensifier pumps 110, as indicated by reference numeral 409, and pre-cooling the hot discharge from the high-pressure intensifier pumps 110 prior to feeding to heat exchanger 112, as indicated by reference numeral 411. Resistance heater 402 may be used to control or otherwise influence the exchange of heat between the two streams. In addition, the selection of material and dimensions of body 400 also influence this exchange.

In one embodiment, the supercritical nitrogen from pre-pump 106 enters into conduit 404 at a temperature of approximately −170° F. to −190° F. and a pressure of between 15,000 and 20,000 psi. Swapper 108 warms this incoming nitrogen to between approximately −140° F. and −40° F. Intensifier pumps 110, as described in greater detail below in conjunction with FIG. 5, raise the pressure of the nitrogen to approximately 55,000 psi and consequently, raise the temperature of the nitrogen to between approximately 50° F. and 150° F. before it re-enters body 400 via conduit 406. After traveling through conduit 406, the temperature of the nitrogen is then cooled to a temperature of between approximately +30° F. to −40° F. before being delivered to heat exchanger 112. System 100 contemplates other suitable temperatures and pressures for the cryogenic fluid flowing through swapper 108.

Figure 5:
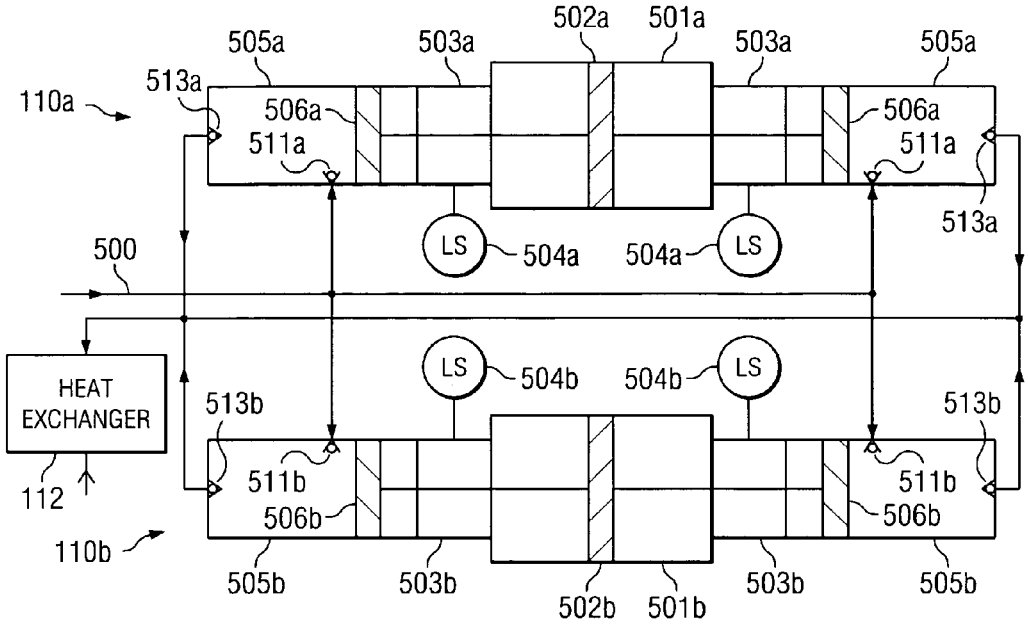
FIG. 5 is a schematic of a pair of intensifiers according to one embodiment of the present invention.

FIG. 5 is a schematic of intensifier pumps 110 according to one embodiment of the present invention. For convenience, FIG. 5 shows each of the intensifier pumps 110*a*, 110*b* with their respective components designated "a" or "b". The following description refers generally to the components without the "a" or "b" designations. In the illustrated embodiment, each intensifier pump 110 includes a hydraulic cylinder 501 having a piston 502 disposed therein, a pair of intermediate spacers 503 coupled to hydraulic cylinder 501, and a pair of high pressure cylinders 505 coupled to intermediate spacers 503. Each intensifier pump 110 also includes a pair of plungers 506 at either end of piston 502 and a pair of limit switches 504. The layout of intensifier pumps 110 are similar to pre-pump 106 except that intensifier pumps 110 do not include jackets around the high pressure cylinders 505 although these could be incorporated if desired. The operation of intensifier pumps 110 is similar to that of pre-pump 106.

Intensifier pumps 110 act as amplifiers converting the intermediate-pressure inlet nitrogen received from a feedline 500 into a high-pressure process discharge fluid before delivering it to heat exchanger 112. To accomplish this, each of intensifier pumps 110 is provided with plungers 506 on each side of piston 502 to generate pressure in both directions of piston travel in such a way that while one side of intensifier pump is in the inlet stroke, the opposite side generates the high-pressure discharge fluid. Therefore, during the inlet stroke of plunger 506, nitrogen enters high pressure cylinder 505 under suction through a suitable-check valve assembly 511. After plunger 506 reverses the motion of travel, the supercritical nitrogen is compressed and exits at an elevated pressure (which is determined by the nozzle orifice diameter and the pump pressure limits) through a suitable discharge check valve assembly 513.

Thus, in one embodiment, intensifier pumps 110 raise the pressure of supercritical nitrogen at between approximately 15,000-20,000 psi to supercritical nitrogen at approximately 55,000 psi by compression. Power system 116 (FIG. 1) provides the power at a suitable pressure and suitable flow rate to operate piston 502 in a reciprocating fashion. Limit switches 504, which may be incorporated into spacers 503, signal electronic controls to shift the directional control valve to reverse the direction of the travel of piston 502.

Figure 6:
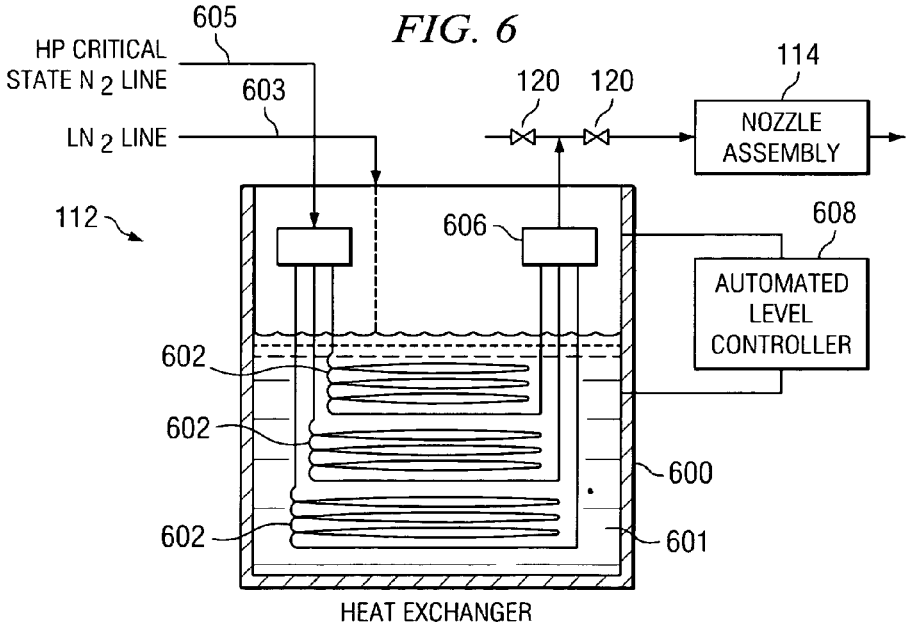
FIG. 6 is a schematic of a heat exchanger according to one embodiment of the present invention.

FIG. 6 is a schematic of heat exchanger 112 in accordance with one embodiment of the present invention. As described above, heat exchanger 112 may be any suitable heat exchanger, such as a shell-and-tube type heat exchanger. In the illustrated embodiment, heat exchanger 112 includes a vessel 600 storing a liquid nitrogen bath 601. Nitrogen may be received via a feedline 603, which may come from liquid nitrogen supply 102 (FIG. 1). Although liquid nitrogen is utilized for the cooling bath 601 in FIG. 6, other suitable coolants are also contemplated by system 100.

Heat exchanger 112 also includes one or more coils 602 that receive supercritical nitrogen from intensifier pumps 110 via a feedline 605. Any suitable arrangement of coils 602 is contemplated by system 100. Depending on the number of coils 602 associated with heat exchanger 112, a distribution manifold 606 may be utilized to distribute the supercritical nitrogen through each of the three coils 602. Liquid nitrogen bath 601 cools the supercritical nitrogen within coil 602 to a minimum temperature of approximately −235° F. for a given pressure of approximately 55,000 psi before delivering it to nozzle assembly 114.

Heat exchanger 112 also includes an automated level controller 608. Similar to the automated level controller 208 of sub-cooler 104 (FIG. 2), automated level controller 608 controls the level of nitrogen bath 601 within vessel 600 in order to control the temperature of the nitrogen exiting heat exchanger 112. The controlling of the temperature of the nitrogen delivered to nozzle assembly 114 is important to the quality of the jet stream produced by nozzle assembly 114.

Figure 7:
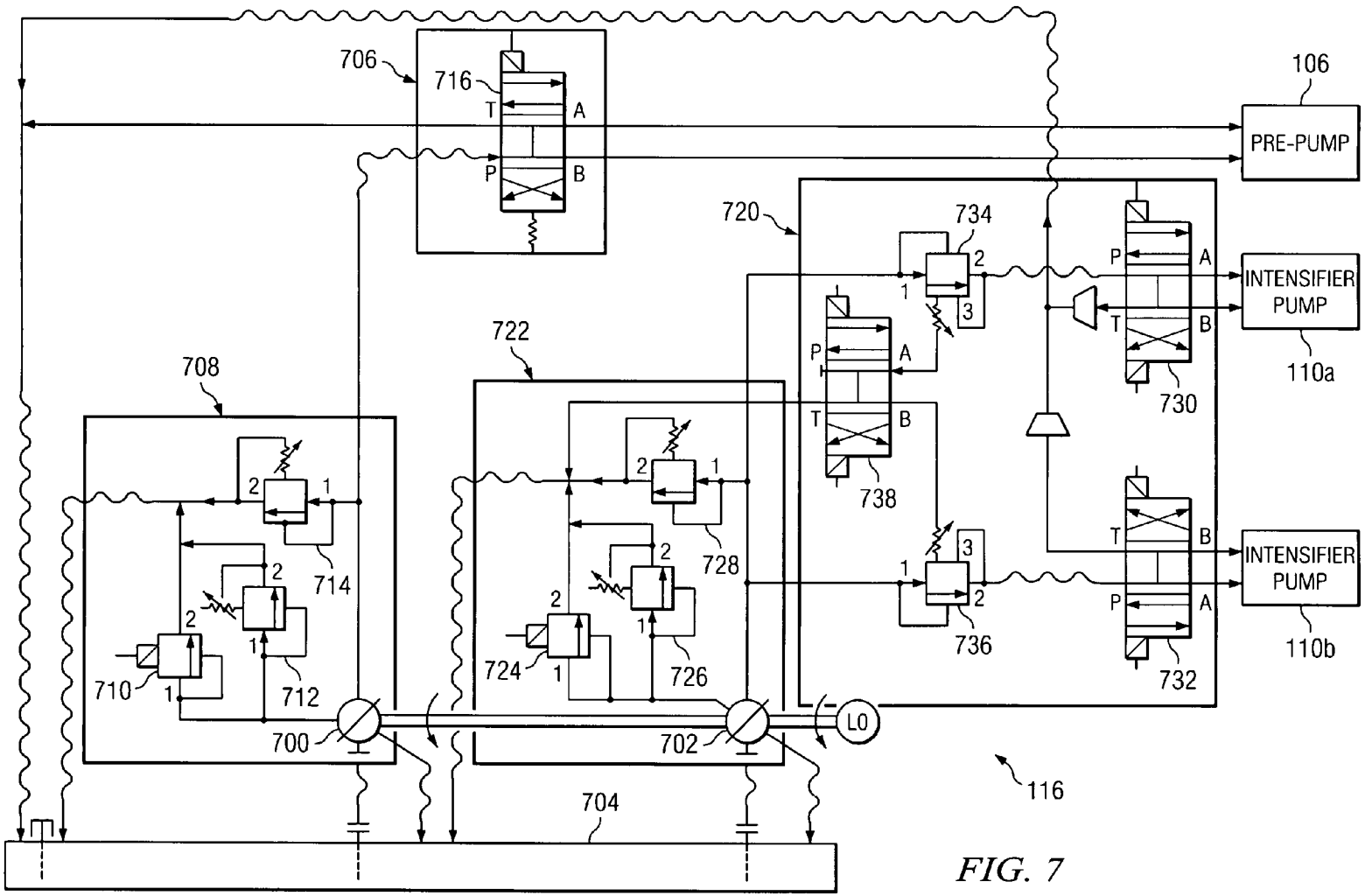
FIG. 7 is a schematic of a hydraulic system according to one embodiment of the present invention.

FIG. 7 is a schematic of power system 116 according to one embodiment of the present invention. Power system 116 functions to provide power to both pre-pump 106 and intensifier pumps 110 and, in the illustrated embodiment, is a hydraulic power system in which both pre-pump 106 and intensifier pumps 110 are fed by separate hydraulic oil pumps 700 and 702, respectively. Pumps 700, 702 are pressure compensated, variable displacement (therefore, variable pressure) pumps that get their oil supply from a common reservoir 704.

Pump 700 provides pressurized oil to pre-pump 106 via hydraulic valves 706. Additionally, oil from a pilot circuit in pump 700 flows through a series of external hydraulic valves 708 that control the displacement of pump 700 itself and thereby control the pressure that pump 700 delivers. External hydraulic valves 708 may be controlled by an operator via controller 122 (FIG. 1) coupled to a programmable logic controller ("PLC"), thus providing flexibility in selecting an appropriate pressure for a particular application.

Pump 700 is operable to provide pressurized oil in a range from approximately 300 psi up to approximately 3000 psi. This pressure is selectable by an operator via controller 122. External hydraulic valves 708 perform the function of remotely varying the displacement and, hence, the pressure of pump 700. Oil flow out of the pilot line enters normally closed proportional control valve ("PCV") 710 and normally closed, manually adjustable pressure regulating valve ("HV") 712. In operation of one embodiment of the invention, HV 712 is set to a value less than 3000 psi as a redundant backup valve in case of a malfunction of PCV 710 during normal operation. PCV 710 is used to set hydraulic oil pump discharge pressures (all lower than that set by HV 712) via controller 122 and the PLC. Both of these valves allow flow of pilot circuit oil back to reservoir 704.

Pressure relief valve ("PRV") 714 is included in external hydraulic valves 708 as a means of relieving any overpressure that may build up in the entire pre-pump hydraulic circuit as a result of hydraulic pump malfunction. It represents an added safety measure in the case of an hydraulic overpressure condition to pre-pump 106.

Hydraulic valves 706 include a 4-way solenoid operated directional flow control valve ("SV") 716 that provides pressurized oil to pre-pump 106. As described above in conjunction with FIG. 3, in one embodiment pre-pump 106 is a double-acting hydraulically driven pump including a double-acting actuator and two cold ends 302 capable of producing pressures of up to 20,000 psi or more. End of travel for piston 309 is determined via limit switches 306 that relay this information to the PLC, which in turn transmits signals to open and close the various control valve ports of SV 716.

In operation of one embodiment of the pre-pump portion of power system 116, when end-of-travel (compression stroke) is sensed for one of the cold ends 302 by the respective limit switch 306, the limit switch 306 relays this information to the PLC, which in turn signals solenoid control valve SV 716 to reverse the current hydraulic oil flow directions. In this embodiment, one port (A or B) on the solenoid control valve SV 716 sees a change from pressurized oil inflow to oil outflow back to reservoir 704 and, conversely, the other port of the solenoid control valve SV 716 sees a change from oil outflow to reservoir 704 to pressurized oil inflow. This has the effect of reversing the direction of movement of piston 309, thereby toggling one cold end 302 from a compression stroke to a suction stroke, while simultaneously changing the opposite cold end 302 from a suction stroke to a compression stroke. This process is then repeated when the opposite cold end 302 reaches its end of travel. This valve sequencing repeats itself continuously, thus providing the pumping action required to pressurize the nitrogen to an intermediate pressure.

Pump 702 provides pressurized oil to intensifier pumps 110 via a series of hydraulic valves 720. Additionally, oil from a pilot circuit in pump 702 flows through a series of external hydraulic valves 722 that control the displacement of pump 702 itself and thereby control the pressure that pump 702 delivers. External hydraulic valves 722 may be controlled by an operator via controller 122 (FIG. 1) coupled to the PLC, thus provide flexibility in selecting an appropriate pressure for a particular application.

Pump 702 is capable of providing pressurized oil in a range from approximately 300 psi up to approximately 3000 psi. This pressure is selectable by an operator via controller 122. External hydraulic valves 722 perform the function of remotely varying the displacement and, hence, the pressure of pump 702. Oil flow out of the pilot line enters normally closed proportional control valve ("PCV") 724 and normally closed, manually adjustable pressure regulating valve ("HV") 726. In operation of one embodiment of the invention, HV 726 is set to a value less than 3000 psi as a redundant backup valve in case of a malfunction of PCV 724 during normal operation. PCV 724 is used to set hydraulic oil pump discharge pressures (all lower than that set by HV 726) via controller 122 and the PLC. Both of these valves allow flow of pilot circuit oil back to reservoir 704.

Pressure relief valve ("PRV") 728 is included in external hydraulic valves 722 as a means of relieving any overpressure that may build up in the entire intensifier hydraulic circuit as a result of pump 702 malfunction. It represents an added safety measure in the case of an hydraulic overpressure condition to intensifier pumps 110.

Hydraulic valves 720 provide pressurized hydraulic oil to hydraulic cylinders 501 of intensifier pumps 110, which compress nitrogen as a supercritical fluid up to 60,000 psi or more. In addition to providing directional flow control of the hydraulic oil to and from each of hydraulic cylinders 501 using two separate directional flow control valves, 730 and 732 (4-way solenoid-operated directional flow control valves), hydraulic valves 720 also sequence the supply of oil to each hydraulic cylinders 501 via "sequencing" valves, PRV 734 and PRV 736, which in one embodiment are ventable, adjustable, pilot-operated pressure relief valves. One PRV is dedicated to each hydraulic cylinder 501, with vent ports of both PRV 734 and PRV 736 controlled by a "phasing" valve SV 738 (a 3-way, solenoid-operated directional flow control valve), which enables and disables the pilot function of each sequencing valve in a phased manner. Opening the vent ports of PRV 734 and PRV 736 (vents pilot flow oil to reservoir 704) disables the pilot function of these same valves and thus bypasses any pressure relief capability the valves possess thereby transmitting the full hydraulic pump pressure once any minimal main stage spring pressure has been overcome. Conversely, when the pilot function is re-enabled (pilot flow is not vented to reservoir), the pressure relief capability of the valves is also re-enabled.

In operation of one embodiment of the intensifier pump portion of power system 116, and with reference to FIG. 5, one intensifier hydraulic piston 502*b* is coming to the end of its stroke and its corresponding plunger 506*b* is in the almost fully extended position. Correspondingly, high pressure cylinder 505*b* is delivering maximum supercritical fluid pressure to a single common high-pressure discharge line that has a pressure-developing orifice installed at its exit. At this same time the limit switch 504*b* is about to signal the end of travel for piston 502*b*. Sequencing valve PRV 736 is fully open (phasing valve SV 738 has opened a route for the vented pilot flow to flow to reservoir 704) thus disabling the pilot function of the sequencing valve PRV 736 and disabling the pressure relief capability of the valve. This configuration transmits hydraulic oil through directional flow control valve SV 732 to hydraulic piston 502*b* at the full pressure being generated at the discharge port of pump 702 (excluding line and valve losses).

Simultaneously, the vent port of sequencing valve PRV 734 does not have a flow route to reservoir 704 because phasing valve SV 738 has blocked this flow path, which enables the pilot function of the valve and thus the pressure relief capability of PRV 734. The impact of enabling the pressure relief capability of PRV 734 is that there is created a differential pressure, ΔP (which may be set manually) across PRV 734 (oil pressure downstream is lower) and consequently SV 730 and hydraulic cylinder 501*a*, equal in magnitude to the pressure created by the adjustable spring setting of PRV 734. This differential pressure, ΔP, translates into a reduction in the discharge pressure exiting high pressure cylinder 505*a* and into the common high pressure discharge line, which is equal to the product of ΔP times the high-pressure cylinder intensification factor.

The pressure in the common single high-pressure discharge line at this point is at the pressure generated previously by high pressure cylinder 505*b*, which was un-impacted by any ΔP-derived pressure reduction, since conditions for the development of a ΔP did not exist for high pressure cylinder 505*b* (the pressure relief capability of PRV 736 was disabled). This combination of conditions causes hydraulic piston 502*a* to stall at an intermediate travel position because the product of the reduced hydraulic oil pressure times the intensification factor of the high pressure cylinder creates an intensifier discharge pressure, less than the back-pressure in the single common high pressure discharge line it must act against. This prevents hydraulic piston 502*a* from progressing any further.

Given this current starting point state, the PLC receives a signal from limit switch 504*b* of high pressure cylinder 505*b* that plunger 506*b* has now reached its end of travel. The PLC then sends a signal to directional flow control valve SV 732 to toggle the hydraulic oil flow directions so that piston 502*b* can begin reversing direction, i.e., oil starts to flow into the opposite side of hydraulic cylinder 501*b* while flowing out of the previously pressurized side. Simultaneously, the PLC sends a signal to phasing valve SV 738 that then shifts and blocks the pilot oil vent flow path of sequencing valve PRV 736 (thus enabling the pressure relief capability of this valve, which in turn creates the previously described differential pressure ΔP) and unblocks the pilot oil vent flow path of PRV 734 to reservoir 704, thus disabling the pressure relief capability and eliminating the pressure differential ΔP.

Elimination of the pressure differential ΔP now enables the full oil pressure developed at the discharge port of hydraulic pump 702 to be effective in driving hydraulic cylinder 501*a*, thereby allowing piston 502*a* to complete its previously stalled compression stroke. This may now occur because the back-pressure in the common high-pressure discharge line is no longer greater than the pressure being discharged from high pressure cylinder 505*a*. Pressurized hydraulic oil from pump 702 continues to flow into the opposite side of hydraulic cylinder 501*b* until piston 502*b* now reaches a stalled intermediate travel position (because of the generation of the differential pressure ΔP on the downstream side of sequencing valve PRV 736. Correspondingly, high pressure plunger 506*a* driven by piston 502*a* has reached its end of travel and corresponding limit switch 504*a* sends a signal to the PLC, which then sends a signal to directional flow control valve SV 730 to toggle the direction of the hydraulic oil flow so that piston 502*a* can begin reversing direction, i.e., oil starts to flow into the opposite side of hydraulic cylinder 501*a* while flowing out of the previously pressurized side.

Piston 502*a* reverses direction until it stalls at which point piston 502*b* (waiting in the stalled position) will no longer be stalled and will complete its full stroke. Piston 502*b* then reaches its end of travel and reverses, at which point piston 502*b* stalls and piston 502*a* (now waiting in the stalled position) resumes and completes its full stroke. In this manner all the high pressure cylinders on each of the intensifier pumps 110*a*, 110*b*, get to play their equal parts. The entire intensifier pumping cycle presented repeats itself continuously, thus providing high-pressure supercritical nitrogen at pressures up to and exceeding 60,000 psi if so desired.

The dual intensifier operation without the use of a surge chamber, wherein one high pressure cylinder compresses nitrogen to a certain pressure and then stalls while another high pressure cylinder now completes its previously-stalled compression stroke, therefore achieves a steady, relatively "pressure-spike free" flow of high pressure supercritical nitrogen to the nozzle by allowing some overlap of the suction and compression phases ("phasing") of the different high pressure cylinders. Without this approach the variations in pressure at the nozzle caused by the time lag between the suction phase and the compression phase of each cylinder, may be quite marked, were the cylinders operated in a fully sequential manner.

Figure 8A:
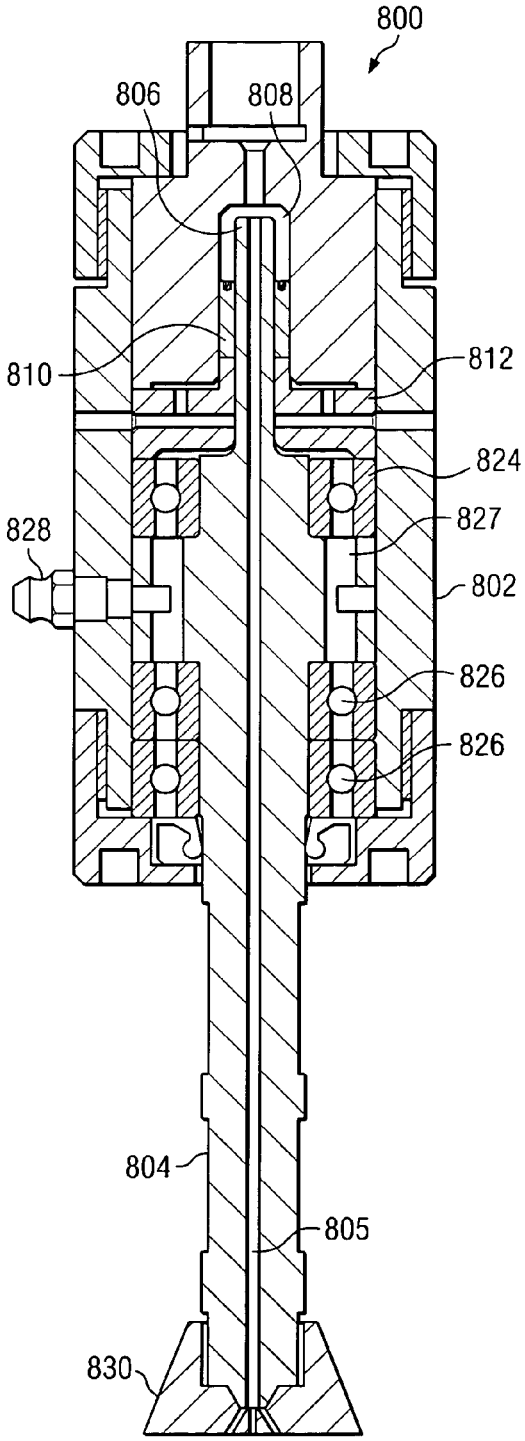
FIGS. 8A through 8C are various schematics of a rotating nozzle assembly according to one embodiment of the present invention.
Figure 8B:
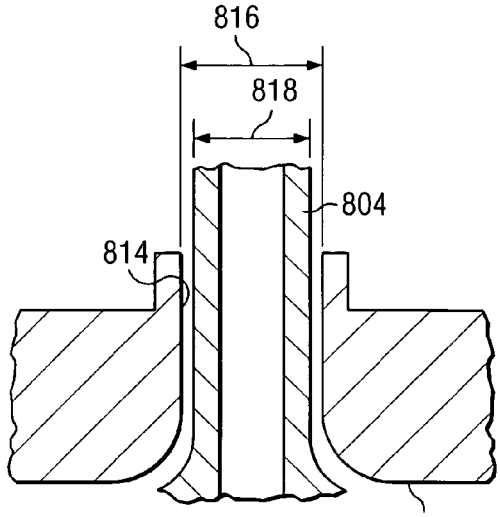
Figure 8C:
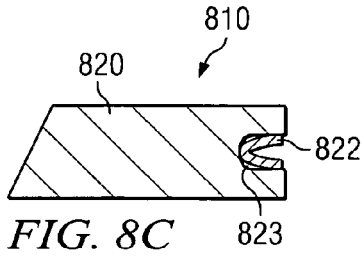

FIGS. 8A, 8B and 8C are various schematics of a rotating nozzle assembly 800 according to one embodiment of the present invention. The present invention contemplates nozzle assembly 800 being adaptable for different platforms, such as being coupled to a robotic arm, a hand held wand, or other suitable active or passive platform depending on the application.

In the illustrated embodiment, nozzle assembly 800 includes a housing 802, a rotatable shaft 804 having a bore 805 running therethrough, a feed chamber 808, a rotating seal 810, a seal backup disc 812, a bearing housing 827 housing a radial bearing 824 and a pair of angular contact bearings 826, a grease nipple 828, and a universal head 830. The present invention contemplates more, less, or different components for nozzle assembly 800 than those shown in FIGS. 8A-8C.

Housing 802 may be any suitable size and shape, and may be formed from any suitable material. Rotatable shaft 804 is partially disposed within housing 802 and has an upstream portion 806 associated with feed chamber 808 in order to receive high pressure cryogenic fluid. Rotatable shaft 804 may have any suitable length and be formed from any suitable material. Bore 805 may also have any suitable diameter. Rotatable shaft 804 may be rotated in any suitable manner, such as a suitable drive assembly (not illustrated).

In the illustrated embodiment, shaft 804 is rotatable with respect to housing 802 by radial bearing 824 and angular contact bearings 826. Any suitable number and any suitable type of bearings may be used in lieu of radial bearing 824 and angular contact bearings 826. In one embodiment, bearings 824, 826 are lubricated with a suitable lubricant. In a particular embodiment of the invention, bearings 824, 826 are lubricated with a cryogenically-rated aerospace grease. In one embodiment, the cryogenically-rated aerospace grease is a perfluoropolyether grease. For example, the grease may be Christo-Lube® MCG-106 manufactured by Lubrication Technology, Inc. In another particular embodiment of the invention, bearings 824, 826 are bearings that require no lubrication. In the embodiment where bearings are used that require no lubrication, bearings may be sputter coated bearings, ceramic bearings, or other suitable bearings that require no lubrication. For example, bearings 824, 826 may be sputter coated with a permanent low friction coating, such as tungsten disulphide.

In order to prevent high pressure nitrogen from leaking from feed chamber 808 into bearing housing 828, seal 810 is disposed within feed chamber 808 and surrounds an upstream portion of rotatable shaft 804. Seal backup disc 812 is disposed proximate the downstream end of seal 810 to keep seal 810 in place as shaft 804 rotates. Seal 810, in one embodiment, is a rotating seal and is described in greater detail below in conjunction with FIG. 8C.

Referring now to FIG. 8B, seal backup disc 812 includes an orifice 814 that surrounds an outside diameter 818 of rotatable shaft 804. In one embodiment, diameter 818 is between 0.187 and 0.1875 inches. According to the teachings of one embodiment of the invention, orifice 814 has a diameter 816 such that, when a cryogenic fluid such as supercritical nitrogen is flowing through bore 805 of rotatable shaft 804, rotatable shaft 804 can freely rotate while seal 810 prevents cryogenic fluid from seeping past seal 810. In one embodiment, this is accomplished by having an orifice diameter 816 of at least 0.191 inches and no greater than 0.193 inches.

Referring to FIG. 8C, seal 810 comprises a body 820 and a spring member 822 disposed within a groove 823 on an upstream end of seal 810. In one embodiment, body 820 is formed from an ultra-high molecular weight polyethylene ("UHMW PE"), which may be oil-filled; however, other suitable materials may be utilized for body 820. Spring member 822, in one embodiment, is a cantilever spring member having a V-shaped cross section; however, spring member 822 may have other suitable cross sections, such as circular. In a particular embodiment of the invention, an inside diameter of seal 810 is between 0.188 and 0.191 inches.

Universal head 830 can be any suitable universal head depending on the application for nozzle assembly 800. For example, if nozzle assembly 800 is a rotating nozzle assembly, then universal head 830 may have a plurality of bores in fluid communication with bore 805 in order to perform a sand blasting operation, for example.

Figure 9A:
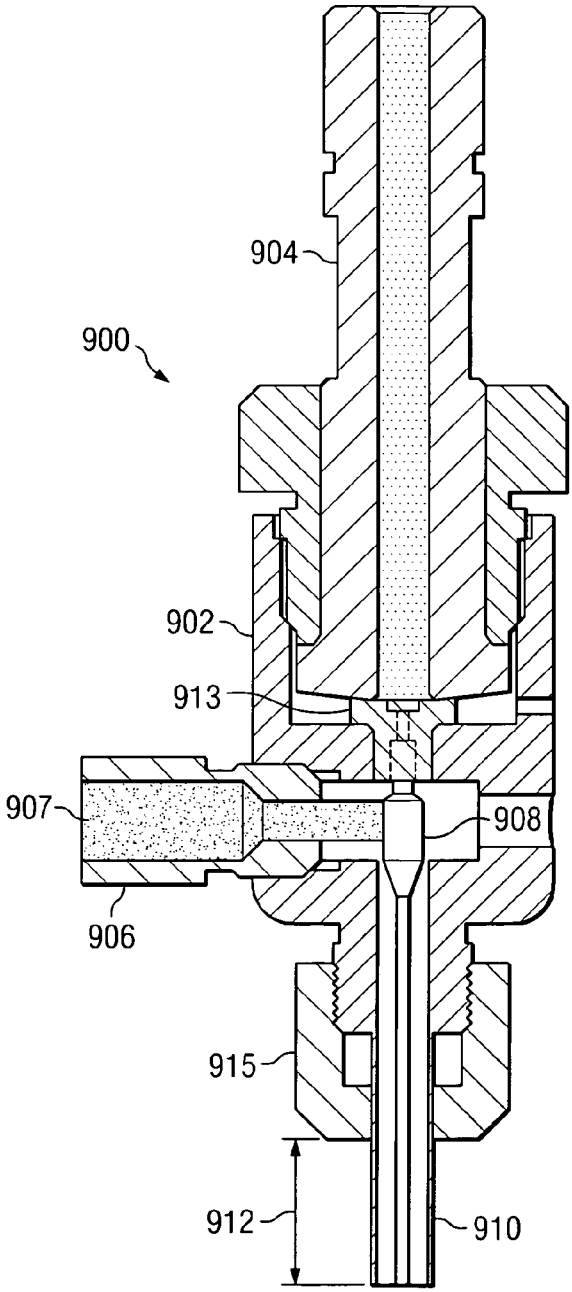
FIG. 9A is a schematic of a nozzle assembly according to one embodiment of the present invention.

FIG. 9A is a schematic of a nozzle assembly 900 according to one embodiment of the present invention. Nozzle assembly 900 may be used for abrading, sandblasting, cold spraying, or other suitable machining or manufacturing process. It may also have the potential of replacing common electroplating. In the illustrated embodiment, nozzle assembly 900 includes a housing 902, a high pressure nitrogen feed 904, an abrasive material feed 906, a mixing chamber 908, and a nozzle 910. The present invention contemplates more, less, or different components for nozzle assembly 900 than those shown in FIG. 9A. In addition, the present invention contemplates combining features of rotating nozzle assembly 800 in FIG. 8A to facilitate rotating with abrasive materials.

Housing 902 may be any suitable size and shape and may be formed from any suitable material, such as stainless steel. Housing 902 may couple to high-pressure supercritical nitrogen feed 904 in any suitable manner, such as a screwed connection. High-pressure supercritical nitrogen feed 904 delivers high-pressure supercritical nitrogen or other suitable cryogen into mixing chamber 908. Before entering mixing chamber 908, the supercritical nitrogen flows through an orifice 913. Orifice 913 may have any suitable diameter, for example approximately 0.012 inches, to control the flow of nitrogen into mixing chamber 908. Mixing chamber 908 may be formed from any suitable material; however, in one embodiment, mixing chamber 908 is formed from a hard material, such as tungsten carbide.

Abrasive material feed 906 may couple to housing 902 in any suitable manner, such as a screwed connection. Abrasive material feed 906 delivers an abrasive material 907 into mixing chamber 908. Abrasive material 907 may be any suitable abrasive material, such as grit, crystalline compounds, glass, metal particles, and carbon dioxide. Abrasive material 907 mixes with supercritical nitrogen in mixing chamber 908, and exits chamber 908 towards a target (not illustrated) via nozzle 910.

Nozzle 910 couples to housing 902 in any suitable manner, such as a collet 915 that is screwed onto housing 902. In one embodiment, nozzle 910 is sized such that the high pressure supercritical nitrogen jet does not lose coherence (i.e., become unstable and lose significant energy) before striking the target. In one embodiment, this is accomplished by having a length 912 of exposed nozzle 910 of no more than two inches. Nozzle 910 may be formed from any suitable material. For example, nozzle 910 may be formed from boron nitride, tungsten carbide, or other suitable hard abrasion resistant material. In one embodiment, the high-pressure supercritical nitrogen exits nozzle 910 at a temperature no colder than −235° F. at a given pressure of no more than 55,000 psi.

Although not illustrated in FIG. 9A, a vacuum shroud or other suitable vacuum system may be associated with nozzle assembly 900 in order to remove any abrasive material 907 exiting nozzle 910 after striking the target. This reduces or eliminates any potential for contamination of the environment.

Figure 9B:
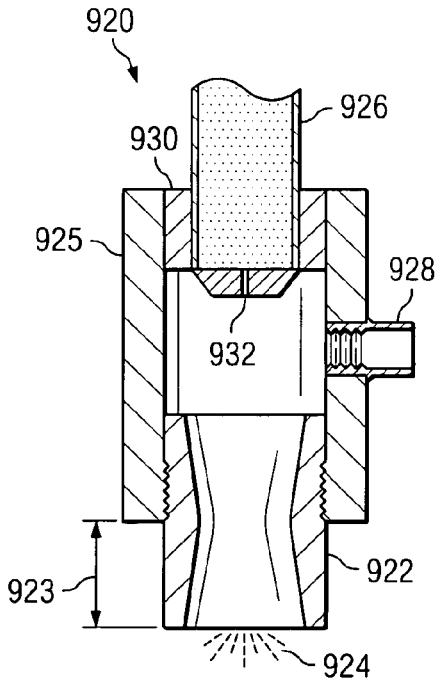
FIG. 9B is a schematic illustrating a different nozzle assembly according to one embodiment of the present invention.

FIG. 9B is a schematic illustrating a different nozzle assembly 920 according to one embodiment of the present invention. As illustrated, nozzle assembly 920 includes a venturi nozzle 922, which may also be a straight nozzle in some embodiments. Venturi nozzle 922 facilitates entrainment of abrasives and a lateral dispersion 924 of the nitrogen/abrasive particle mixture exiting nozzle 922 for the purposes of providing a large area of contact suitable for cleaning and abrading. A length 923 of nozzle 922 may be any suitable length. In addition, nozzle 922 may have any suitable diameters associated therewith. Venturi nozzle 922 may be formed from any suitable material, such as a metal. In one embodiment, venturi nozzle 922 is lined with a ceramic material.

Nozzle assembly 920 also includes a housing 925, to which a high pressure nitrogen line 926 and an abrasive particle feed 938 is coupled thereto in any suitable manner. A seal 930 surrounds an outside perimeter of nitrogen line 926 and may be any suitable seal formed from any suitable material. Nitrogen line 926 includes an orifice 932 formed in an end thereof that may have any suitable diameter, such as between approximately 10 and 12 mils.

Abrasive particle feed 938 may be either a positive feed or a venturi-suction feed that directs abrasive particles into housing 925 for mixing with nitrogen. Any suitable abrasive particles may be utilized.

Although embodiments of the invention and some advantages are described in detail, a person skilled in the art could make various alterations, additions, and omissions without departing from the spirit and scope of the present invention as defined by the appended claims.

What is claimed is:

1. A cryogenic fluid delivery system, comprising:

a vessel containing a cryogenic fluid at a first pressure and a first temperature;

a first heat exchanger coupled to the vessel for receiving the cryogenic fluid and cooling the cryogenic fluid to a second temperature, wherein the first heat exchanger includes a first automated level controller for automatically controlling a level of the cryogenic fluid within the first heat exchanger;

a first pump coupled to the first heat exchanger for pressurizing the cryogenic fluid to a second pressure;

a second pump for pressurizing the cryogenic fluid to a third pressure;

a second heat exchanger coupled to the second pump for cooling the cryogenic fluid to a third temperature, wherein the second heat exchanger includes a second automated level controller for automatically controlling a level of the cryogenic fluid within the second heat exchanger; and a nozzle coupled to the second heat exchanger for delivering a jet of the cryogenic fluid toward a target.

2. The system of claim 1, further comprising a dump valve assembly coupled between the second heat exchanger and the nozzle for bleeding off some of the cryogenic fluid.

3. The system of claim 1, wherein the cryogenic fluid comprises nitrogen.

4. The system of claim 1, wherein the second pressure is between approximately 15,000 and 20,000 pounds per square inch.

5. The system of claim 1, wherein the third pressure is between approximately 50,000 and 60,000 pounds per square inch.

6. The system of claim 1, wherein the third temperature is no colder than approximately −235° F. and the third pressure is approximately 55,000 pounds per square inch.

7. The system of claim 1, further comprising a recirculation pump coupled between the first heat exchanger and the first pump for recirculating some of the cryogenic fluid from the first pump back to the first heat exchanger.

8. The system of claim 1, further comprising a power system for supplying energy to control at least the first and second pumps, the power system selected from the group consisting of a hydraulic system, a pneumatic system, and an electric system.

9. The system of claim 1, further comprising a third heat exchanger coupled between the first pump and the second pump for heating the cryogenic fluid to a fourth temperature.

10. The system of claim 9, wherein the third heat exchanger comprises:

a body;

a resistance heater disposed within the body; and first and second conduits extending through the body to transport the cryogenic fluid through the body.

11. The system of claim 10, wherein the cryogenic fluid enters into the first conduit at a temperature of between approximately −170° F. to −190° F. and exits first conduit at a temperature of between approximately −140° F. and −40° F.

12. The system of claim 10, wherein the cryogenic fluid enters the second conduit at a temperature of between approximately 50° F. and 150° F. and exits the second conduit at a temperature of between approximately +30° F. to −40° F.

13. The system of claim 10, wherein the body is formed from aluminum.

14. The system of claim 1, wherein the automated level controllers comprise differential pressure transducers.

15. A method for delivering cryogenic fluid, comprising:

cooling a cryogenic fluid from a first temperature to a second temperature using a first heat exchanger;

automatically controlling a level of the cryogenic fluid within the first heat exchanger;

pressurizing the cryogenic fluid from a first pressure to a second pressure using a first pump;

pressurizing the cryogenic fluid from the first pressure to a second pressure;

cooling the cryogenic fluid to a third temperature using a second heat exchanger;

automatically controlling a level of the cryogenic fluid within the second heat exchanger; and delivering a jet of the cryogenic fluid toward a target.

16. The method of claim 15, further comprising bleeding off some of the cryogenic fluid before delivering the jet.

17. The method of claim 15, wherein the cryogenic fluid comprises liquid nitrogen.

18. The method of claim 15, wherein the second pressure is between approximately 15,000 and 20,000 pounds per square inch.

19. The method of claim 15, wherein the third pressure is between approximately 50,000 and 60,000 pounds per square inch.

20. The method of claim 15, wherein the third temperature is no colder than approximately −235° F. and the third pressure is approximately 55,000 pounds per square inch.

21. The method of claim 15, further comprising recirculating some of the cryogenic fluid back to the first heat exchanger.

22. The method of claim 15, further comprising heating the cryogenic fluid to a fourth temperature using a second heat exchanger coupled between the first pump and the second pump.

23. A cryogenic fluid delivery system, comprising:

a vessel containing a cryogenic fluid at a first pressure and a first temperature;

a first heat exchanger coupled to the vessel for receiving the cryogenic fluid and cooling the cryogenic fluid to a second temperature;

a first pump coupled to the first heat exchanger for pressurizing the cryogenic fluid to a second pressure;

a recirculation pump coupled between the first heat exchanger and the first pump for recirculating at least some of the cryogenic fluid from the first pump back to the first heat exchanger;

a second pump for pressurizing the cryogenic fluid to a third pressure;

a second heat exchanger coupled to the second pump for cooling the cryogenic fluid to a third temperature; and a nozzle coupled to the second heat exchanger for delivering a jet of the cryogenic fluid toward a target.

24. A cryogenic fluid delivery system, comprising:

a vessel containing a cryogenic fluid at a first pressure and a first temperature;

a first heat exchanger coupled to the vessel for receiving the cryogenic fluid and cooling the cryogenic fluid to a second temperature;

a first pump coupled to the first heat exchanger for pressurizing the cryogenic fluid to a second pressure;

a second pump for pressurizing the cryogenic fluid to a third pressure;

a second heat exchanger coupled to the second pump for cooling the cryogenic fluid to a third temperature;

a third heat exchanger coupled between the first pump and the second pump for heating the cryogenic fluid to a fourth temperature; and a nozzle coupled to the second heat exchanger for delivering a jet of the cryogenic fluid toward a target.

* * * * *